US007644522B2

(12) United States Patent
Ramirez

(10) Patent No.: US 7,644,522 B2
(45) Date of Patent: Jan. 12, 2010

(54) SOLES WITH ADJUSTABLE AND INTERCHANGEABLE SUPPORTS

(76) Inventor: Manuel Ramirez Martinez Ramirez, Ignacio Altamirano #1724 Col. Maestros, Ensenada, Baja California (MX) 22840

( * ) Notice: Subject to any disclaimer, the term of this patent is extended or adjusted under 35 U.S.C. 154(b) by 822 days.

(21) Appl. No.: 11/249,656

(22) Filed: Oct. 12, 2005

(65) Prior Publication Data

US 2007/0079532 A1 Apr. 12, 2007

(51) Int. Cl.
*A61F 5/14* (2006.01)
*A43B 13/38* (2006.01)

(52) U.S. Cl. ..... 36/160; 36/43; 36/155

(58) Field of Classification Search ..... 36/35 R, 36/43, 44, 155, 160, 181
See application file for complete search history.

(56) References Cited

U.S. PATENT DOCUMENTS 4,841,648 A * 6/1989 Shaffer et al. ..... 36/43
5,138,774 A * 8/1992 Sarkozi ..... 36/164
6,000,147 A * 12/1999 Kellerman ..... 36/44
6,105,283 A * 8/2000 Park ..... 36/159
6,434,859 B1 * 8/2002 Kim ..... 36/43
6,715,221 B1 * 4/2004 Sasaki ..... 36/141
6,742,289 B2 * 6/2004 Celmo ..... 36/141
6,990,756 B1 * 1/2006 Johnson ..... 36/155
7,069,665 B1 * 7/2006 Adriano ..... 33/515
7,107,705 B2 * 9/2006 Dalton et al. ..... 36/44
7,210,250 B2 * 5/2007 Gallegos ..... 36/44
2001/0032400 A1 * 10/2001 Brooks ..... 36/102

* cited by examiner

*Primary Examiner*—Jila M Mohandesi
*Assistant Examiner*—Sharon M Prange
(74) *Attorney, Agent, or Firm*—Andrew Schroeder

(57) ABSTRACT

A shoe insert system with adjustable and interchangeable supports comprising: a base sole, a longitudinal arch, a heel insert, and a transverse arch; the base sole being generally planar and having a perimeter which covers the underside of a foot from the heel region up to the bottom of a person's toes, a longitudinal arch, the longitudinal arch having a d-shape with perforated holes and a row of pins sized to mate with perforations of the base sole, a heel insert, the heel insert having alternating perforated holes and pins near the edge defining a general circumference of the heel insert, the pins are sized to mate with corresponding perforated holes on the base sole, the transverse arch having a hole side and a pin side, the transverse arch having a series of perforated holes on the hole side and at least one pin sized to mate with a corresponding perforated hole on the base sole on the hole side.

1 Claim, 3 Drawing Sheets

SOLES WITH ADJUSTABLE AND INTERCHANGEABLE SUPPORTS

FIELD OF THE INVENTION

The present invention relates to the health industry as it pertains to feet.

BACKGROUND OF THE INVENTION

There abound a panoply of products in the marketplace designed to comfort a person's foot. Many of these products are inserted into a shoe which acts as a support. These products are designed to alleviate the stress and impact which ensues when one places the full force of their body onto their feet. An average man may weigh approximately 200 pounds which must be placed upon feet with a surface area of approximately 70-80 square inches. Over the course of a day as this person walks a couple miles with hard wooden heels a great deal of stress is directed towards the feet.

Moreover, if a person's feet do not absorb the pressure from the weight of his body properly, the force will be re-allocated elsewhere. For some people, this force and stress may be re-allocated to their knees. For others, this force and stress may be re-allocated to their back. This residual stress to other areas of a person's body may lead to severe back problems, knee problems, and foot-related maladies.

To alleviate these problems most of the shoe inserts offered in the marketplace are essentially a one piece cushion shaped to conform to the outside of a person's foot. The problem with most shoe inserts is the fact that they are soft and do not offer true support to re-direct force and correct balance. A soft shoe insert offers no more support to a person's foot as a tire made out of glass to be mounted on a car. Although a person may receive short-term comfort when using a soft shoe insert, such respite is soon replaced by the same pain and stress. And even if a person does feel measurably better, this is most likely a placebo effect which cannot be sustained.

Another problem with the prior art is the fact that most shoe inserts and similar products are essentially one-piece articles of manufacture. The only way they can conform to a person's foot is through the lateral outline of a person's foot. Unfortunately, each person's foot is idiosyncratic and singular with respect to the under-side of the feet. Each person possesses a foot with an underside which is as unique as a fingerprint. Some people possess wide arches. Some people possess narrow arches. Some people are flat-footed. Some people possess short toes. Some people possess long toes. And some people possess asymmetrical feet, i.e. feet which are different in size and shape in comparison with each other. And others may be missing some toes altogether. The prior art ignores these singularities and does not provide for precision custom-fitting with regards to the undersides of a person's feet.

Another problem which inheres with the prior art is the fact that they do not address the problem of poor balance. For those people who are missing toes, possess one leg which is slightly longer than the other, asymmetrical feet, etc., the prior art's "one size fits all" approach proves inadequate. The prior art does not provide for a way of re-directing or shifting a person's weight properly so that it will impart good balance.

Therefore, what is needed in the art is a custom-fitting system for the support of feet. Such a system should be hard enough to provide a strong foundation for a person's balance. In addition, such system should possess several different pieces which can properly dovetail with the underside of a person's foot.

SUMMARY OF THE INVENTION

The present invention is designed to provide proper support to a person and to correct a person's balance through use of a shoe insert system. The present invention provides a user with an interchangeable and adjustable system by which a proper custom fitting may be achieved. Through use of the present invention a user may gain more comfort, balance, and may alleviate any attendant pain and aches often associated with wearing various types of shoes.

The present invention is a shoe insert system with adjustable and interchangeable supports comprising: a base sole, a longitudinal arch, a heel insert, and a transverse arch; the base sole being generally planar and having a perimeter which covers the underside of a foot from the heel region up to the bottom of a person's toes, a longitudinal arch, the longitudinal arch having a d-shape with perforated holes and a row of pins sized to mate with perforations of the base sole, a heel insert, the heel insert having alternating perforated holes and pins near the edge defining a general circumference of the heel insert, the pins are sized to mate with corresponding perforated holes on the base sole, the transverse arch having a generally planar side and a convex side, the transverse arch having a series of perforated holes and at least one pin sized to mate with a corresponding perforated hole on the base sole.

BRIEF DESCRIPTION OF THE DRAWING FIGURES

DESCRIPTION OF PREFERRED EMBODIMENTS

According to a preferred embodiment of the present invention, a unique system comprised of several different articles of manufacture are used to provide support and balance to a person's feet and body. The system along with the attendant articles of manufacture are described in enabling detail below.

Figure 1:
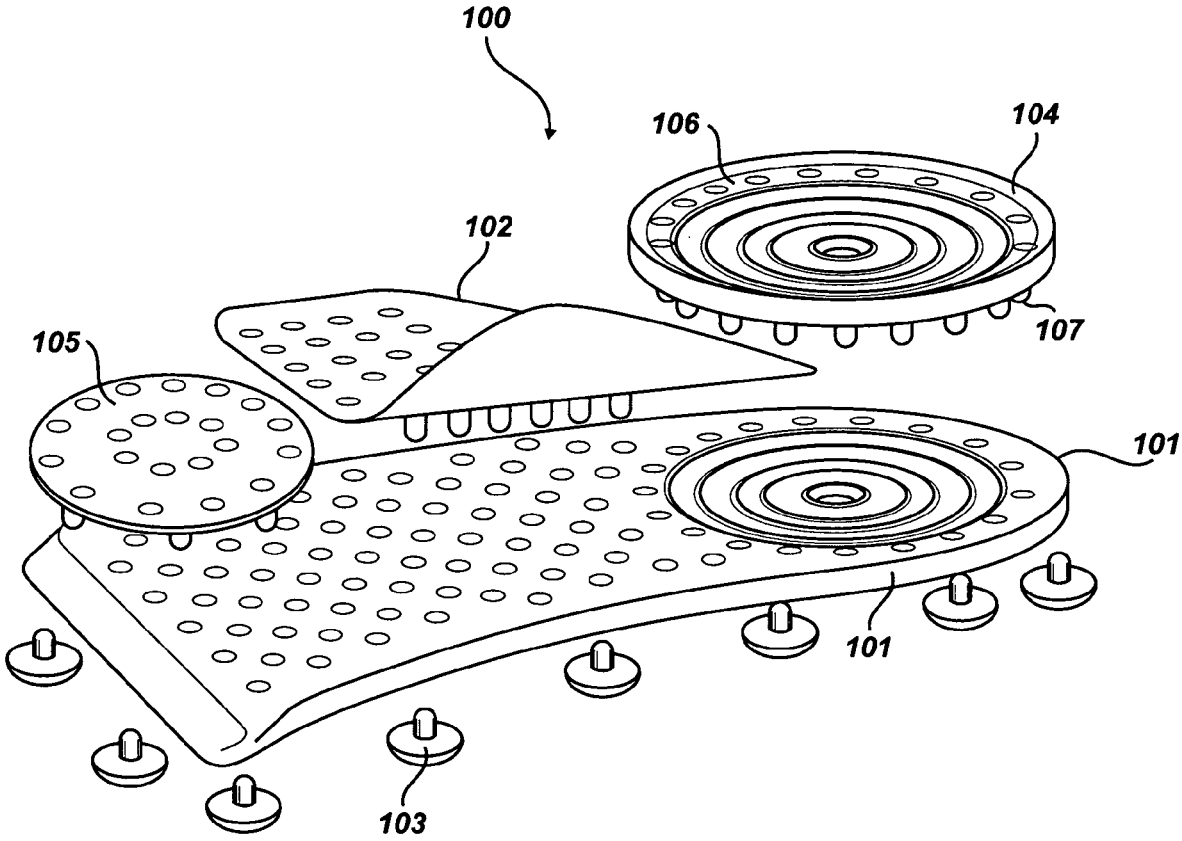
FIG. 1 is a perspective view of a preferred embodiment of the present invention.

FIG. 1 illustrates a preferred embodiment of the present invention. Foot support system 100 is comprised of several different pieces. The types of pieces which are used will be dictated primarily by the morphology of a person's foot. Other factors which will dictate which pieces which will be used include: personal comfort, balance, alleviation of pain in the back, knees, etc. In addition, a person may choose to assemble the foot support system 100 in such a way as to conform to general precepts of Chinese medicine which will be detailed below. It must be pointed out here that it is not specifically required that all of the pieces of the foot support system 100 be used together to work effectively. The morphology of some feet may dictate the dispensation of some pieces herein described.

Foot support system 100 in a preferred embodiment includes a base sole 101, a longitudinal arch 102, buttons 103, a heel insert 104, and a transverse arch 105. It must be pointed out here that in a foot support system, there may be several different sizes of said components which will vary in length, depth, width, etc. Therefore, it is not specifically required that any of said components possess certain measurements or sizes. Therefore, the specific dimensions of the foot support system 100 and any of its attendant components are not to be construed as limiting to the scope of the present invention.

In one preferred embodiment the components of the present invention are made of polypropylene. The components are fabricated by using injection molding. The reason why polypropylene is used is because it is hard and firm. Another reason is because it is a sanitary material. However, the use of polypropylene is mentioned merely as one preferred material to compose the present invention. There abound a panoply of other materials which may also be amenable to injection molding and which may prove equally expedient to serve the essential objectives of the present invention. As such, the use of polypropylene is not specifically required in the present invention. Therefore, the use of polypropylene should not be construed to be limiting the scope of the present invention because other equally fungible materials may be interchangeably used.

Figure 2:
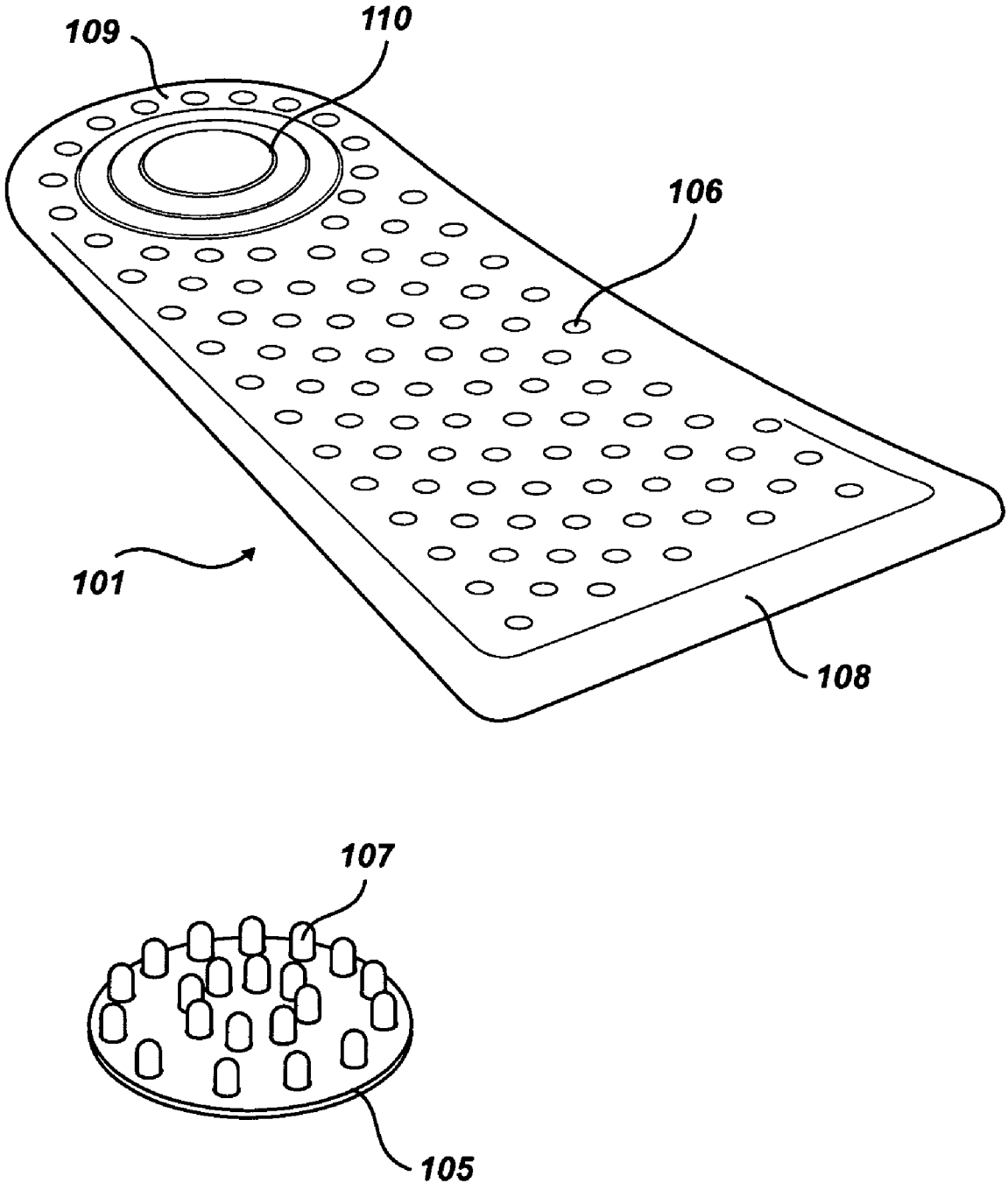
FIG. 2 is a perspective view of a preferred embodiment of the present invention.

The base sole 101 is perforated with several holes 106 as illustrated in FIGS. 1 and 2. These holes 106 achieve two primary objectives. The first objective is to provide a means of attachment with the other pieces of the foot support system 100. Holes 106 will mate with the pins 107 which protrude from the other components of the foot support system 100. Another function the holes 106 accomplish is to allow for ventilation of air throughout the shoe. Without ventilation moisture combined with heat will make a suitable environment for mold, fungus, and other bacteria to propagate. This will lead to malodorous smells as well as athlete's foot. In some preferred embodiments the base sole 101 may further incorporate a series of concentric circles which are cut at a depth of approximately half of the thickness of the base sole.

Holes 106 are spaced substantially equidistantly from each other in several rows extending length-wise from top 108 to bottom 109. And in some preferred embodiments, there is a group of holes 106 which are spaced in a circular fashion towards the bottom 109 which may be described as the heel region of the foot.

Located at the bottom 109 (the heel region) of the base sole 101 in a preferred embodiment are a series of concentric circles 110 spaced substantially equidistantly from each other. In a preferred embodiment there are between three to five concentric circles 110. The concentric circles function to stimulate circulation throughout a person's feet. As energy is applied to the heel of a person's foot, said energy and force is radiated outwards by the concentric circles 110. As energy radiates from the center of the heel, blood circulation is thereby stimulated. Another function of the concentric circles 110 is to spread out the force and energy which is applied to the heel. By dispersing the energy from the heel, the feet and the rest of a person's body is in a better position to absorb the shock and energy and re-allocate the force and energy.

Figure 3:
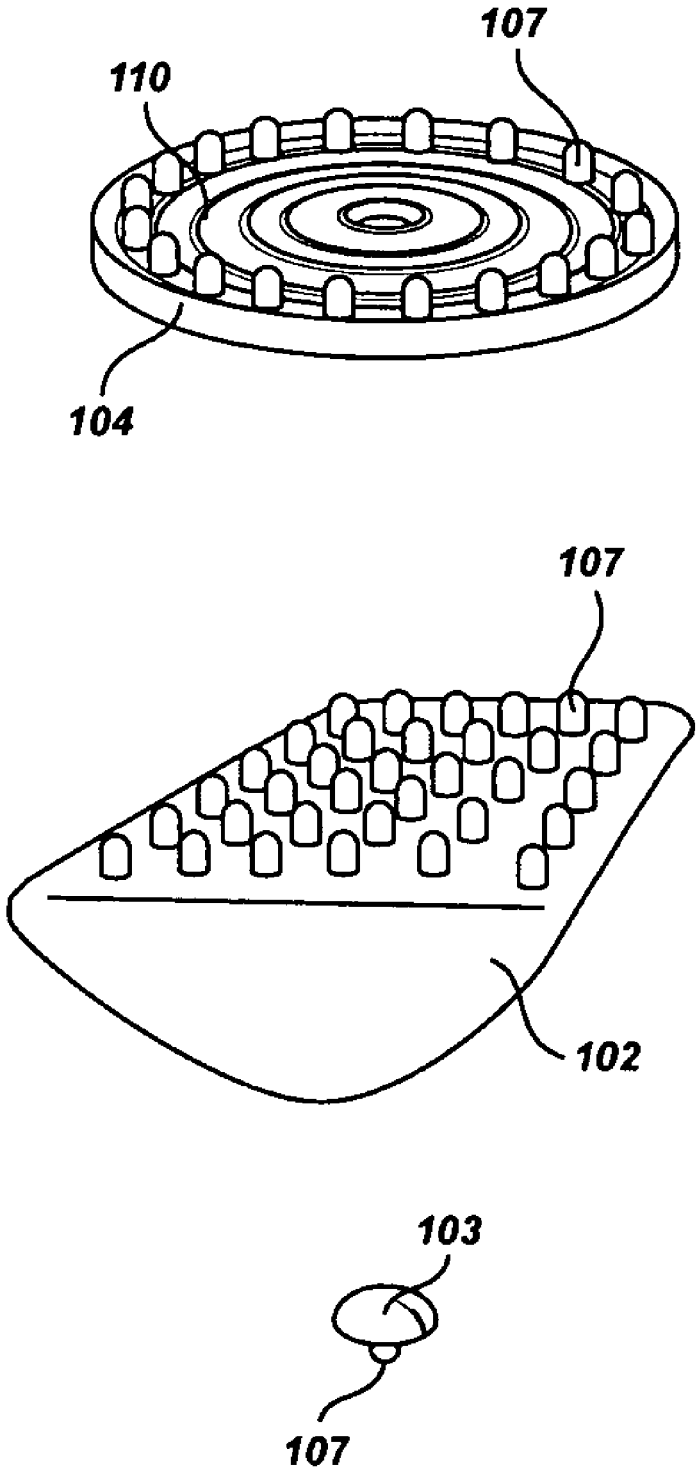
FIG. 3 is a perspective view of a preferred embodiment of the present invention.

FIG. 3 illustrates a longitudinal arch 102 which is used to conform to the arch of a person's foot. The longitudinal arch 102 is a "D" shaped member. For this reason, the longitudinal arch 102 will be placed above the concentric circles 110. However, the exact placement will be dictated by the particular morphology of a person's foot. For this reason, there are several holes 106 on the left and right sides of the base sole 101 which allow the user to place the longitudinal arch 102 at several different points up and down the base sole 101. On the underside of the longitudinal arch 102 there is a row of pins 107 spaced substantially equidistantly from each other for the purpose of mating with the holes 106 of the base sole 101. And as with the base sole 101 there are a series of holes 106 which are used for the purpose of ventilation.

Due to the idiosyncratic morphologies of the arches of people's feet, several longitudinal arches 102 of varying depths, lengths and widths may be included in a system for the present invention. And in some preferred embodiments, the longitudinal arches 102 may even have complimentary pins 107 and holes 106 to mate with each other for the purpose of combining depths to conforms to the morphology of a person's foot.

Heel insert 104 is typically placed towards the bottom of the base sole 101. Heel insert 104 possesses a series of holes 106 along the border. And alternated by the series of holes 106 are a series of pins 107 which are sized to mate with the holes 106 spaced around the concentric circles 110 of the base sole 101. In a preferred embodiment, there are two types of heel inserts 104. In one preferred embodiment, the heel insert 104 possesses a series of concentric circles 110 similar to that of the base sole. The series of concentric circles may be cut at a depth of approximately half the thickness of the heel insert. In other preferred embodiments, the heel insert possesses a round orifice through the center which makes the heel insert 104 donut shaped. However, even with the donut shaped heel inserts 104 there may be concentric circles 110 spaced around the round orifice. Although the heel inserts 104 in a preferred embodiment may include concentric circles 110, holes 106, and pins 107, it is not specifically required that the heel inserts possess such components. Heel inserts may be fabricated in other ways which do not incorporate such components, but may still be able to mate or dovetail with the base sole. Therefore, the present invention does not specifically require that the heel insert 104 incorporate holes 106, concentric circles 110, or pins 107. Therefore, the use of holes 106, concentric circles 110 or pins is not meant to limit the scope of the present invention. These components were mentioned merely for exemplary and illustrative purposes only.

Transverse arch 105 is a substantially circular piece which is typically placed above the concentric circles 110 of the base sole 101. Transverse arch possesses a series of holes 106 which are spaced substantially equidistantly from each other. Said holes 106 are typically spaced in a radial fashion. Holes 106 primarily serve the purpose of ventilation.

FIGS. 1 and 2 illustrates a transverse arch 105. Transverse arch 105 possesses two sides. In some preferred embodiments, one side of the transverse arch 105 is substantially flat and planar. Whereas, the opposite side of the transverse arch 105 is substantially convex. On the convex side of the transverse arch 105 is a pin 107 which is sized to mate with a corresponding hole on the base sole 101. In some preferred embodiments the transverse arch 101 only possesses one pin 107. In other preferred embodiments, the transverse arch 101 may possess a plurality of pins 107 which is spaced in such a fashion to fit with a plurality of corresponding holes 106 located upon the base sole 101. And in yet other preferred embodiments the transverse arch 105 may be fabricated with the pin 107 on the flat/planar side instead of the convex side.

As with other components of the present invention, the transverse arch 105 may come in varying widths and depths to conform with the particular morphology of a person's foot. And in some preferred embodiments the transverse arch may not necessarily possess pins 107 or holes 106. There may be other means of affixing transverse arch 105 with the base sole 101 which may prove equally expedient. As such, the present invention does not specifically require the use of holes 106 or pins 107. The use of holes 106 and pins 107 are mentioned for exemplary and illustrative purposes only.

Buttons 103 are adaptable for use with just about any other component of the present invention which has a hole 106 which it may be conjoined with. On one side of the button 103 there is a pin 107 which is sized to mate with a hole of the other components of the present invention, especially the base sole 101. The side opposite the pin 107 is substantially convex.

The main purpose of the buttons 103 are to actuate various pressure points in the human body. According to various Chinese modalities of medicine various points along a person's foot correspond with another body part such as the back, the face, hands, torso, etc. There exist Chinese maps which enumerate and locate these various points of the foot and illustrate the effect of pressing this particular pressure point along with the concomitant body part to which this pressure point is associated with. For instance, if one were to experience pain in his knees, one would reference said Chinese foot map. This person would then find the location of the foot which corresponds with knee pain and place a button 103 at the point on the base sole which will actuate the pressure point associated with knee pain.

It must be pointed out here that the present invention does not specifically require the use of buttons 103 for use with the present invention. Nor does the present invention require use of maps of Chinese modalities of medicine. Moreover, the present invention makes no claims to the actual efficacy of such Chinese modalities of medicine. The mentioning of the buttons 103 is solely for illustrative and exemplary purposes only. The present invention along with its attendant objectives may be achieved without the use of the buttons 103. As such, the present invention should not be construed to mean that the use of buttons 103 is necessarily included with the present invention.

It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. A shoe insert system with adjustable and interchangeable supports comprising: a base sole, a heel insert, longitudinal arch support, buttons, a transverse arch support, the base sole being generally planar and having a perimeter which covers the underside of a foot;

the base sole further comprises perforated holes and a series of concentric circles;

the perforated holes extending in a row along both lateral sides of the base sole and also extending in rows in the middle of the base sole;

the concentric circles are cut at a depth of approximately half of the thickness of the base sole;

the longitudinal arch support having a d-shape with perforated holes and a row of pins sized to mate with perforations of the base sole;

the heel insert having alternating perforated holes and pins near the edge defining a general circumference of the heel insert, the pins are sized to mate with corresponding perforated holes on the base sole;

the heel insert further comprising a series of concentric circles cut at a depth of approximately half the thickness of the heel insert;

the transverse arch support having a hole side and a pin side, the transverse arch support having a series of perforated holes on the hole side and at least one pin sized to mate with a corresponding perforated hole on the base sole;

the buttons having a generally convex side, and a generally planar side, the planar side having a pin sized to mate with a corresponding perforated hole on the base sole.

* * * * *